United States Patent [19]

Piccagli

[11] 4,193,716

[45] Mar. 18, 1980

[54] IMPERMEABLE WALL CONSTRUCTION

[76] Inventor: Ugo Piccagli, 4511 Harry's La., Dallas, Tex. 75229

[21] Appl. No.: 869,330

[22] Filed: Jan. 13, 1978

[51] Int. Cl.[2] ..... E02D 3/12

[52] U.S. Cl. ..... 405/267

[58] Field of Search ..... 61/35, 59, 56.5, 53, 61/52, 53.6, 53.62, 53.64, 53.66; 264/31

[56] References Cited

U.S. PATENT DOCUMENTS

| | | | |
|---|---|---|---|
| 3,552,130 | 1/1971 | Landau | 61/35 |
| 3,759,044 | 9/1973 | Caron | 61/35 |

*Primary Examiner*—Jacob Shapiro

*Attorney, Agent, or Firm*—Larson, Taylor and Hinds

[57] ABSTRACT

A method of constructing an impermeable wall in the ground having no joints is disclosed. The method overcomes the problems of forming an impermeable joint between a series of individually dug slots. The improvement includes excavating at least one portion of trench in the ground at a width and depth required for the wall, replacing excavated material from the trench with bentonite-water slurry, and after completing the excavation, replacing a predetermined amount of the bentonite-water slurry with cement. The cement is mixed with the remaining bentonite-water slurry in the one portion of trench to produce an evenly mixed cement-bentonite-water slurry. After this slurry has gelled, the above steps are repeated on adjacent portions of trench, and the completed trench then allowed to harden and form a single impermeable wall.

5 Claims, No Drawings

IMPERMEABLE WALL CONSTRUCTION

The present invention relates to a method for constructing an impermeable wall in the ground. More particularly, the present invention relates to a method of constructing a long impermeable wall in the ground in one continuous section rather than the more common route which requires a plurality of vertical wall sections and generally a seal between sections.

The method of digging slots or trenches having vertical walls by replacing the excavated earth by a liquid formed of thixotropic clay in suspension, referred to as bentonite, is known. The bentonite-water slurry prevents the walls of the slot or trench from collapsing during the excavating step. After excavation of the trench, the bentonite-water slurry is pumped out at the same time as concrete or cement is poured into the trench. The pouring of concrete or cement into the trench preferably takes place through a tremie pipe which initially has its end at the bottom of the trench. The tremie pipe is slowly raised as the concrete or cement fills up the trench, replacing the bentonite-water slurry. Thus the tremie pipe has to be raised at approximately the same speed as the concrete or cement is poured into the trench. Great care is taken not to mix the cement and bentonite slurry, and the bentonite can be reused in another excavation.

One such example of forming impermeable walls is disclosed in my U.S. Pat. No. 3,796,054 which issued on Mar. 12, 1974. In this method a first series of vertical slots are first excavated, the earth being replaced with a liquid thixotropic clay mixture. The slots are in line and concrete is poured into the slots to replace the thixotropic liquid. Following the hardening of the concrete in the first series of slots, a second series of slots is excavated between the first series of slots again, the earth being replaced with a thixotropic liquid and this second series of slots is filled with concrete. A special flexible membrane is located between adjoining slots and is sealed into the concrete in adjoining slabs so the resulting wall is impervious. This system works well, however, it requires excavation of vertical slots which is generally done by means of a chisel or a toothed grab and furthermore it requires flexible membranes between the concrete in adjacent slots.

Another method for making an impervious wall is shown in U.S. Pat. No. 3,759,044 wherein a first series of slots are excavated and the excavated earth replaced with a mixture of a thixotropic liquid such as a bentonite-water slurry and cement. After completion of the excavation, the cement-bentonite-water slurry is allowed to harden, and the intervening slots are excavated and filled with a cement-bentonite-water slurry during the excavation step. When the cement in the intervening slot hardens, it is found that an impermeable joint occurs between the bentonite cement walls to prevent liquids passing therethrough and thus a flexible membrane need not be utilized as disclosed in my U.S. Pat. No. 3,796,054. However, certain problems occur with the excavation of slots in a mixture of bentonite and cement. This cement-bentonite-water slurry has a syrupy viscous consistency which gets into a filter cake and hinders the excavation of earth from the bottom of the trench or slot. Furthermore, one still has to excavate a series of vertical slot trenches which require a chisel or a toothed grab and this type of excavation is both slow and requires special equipment.

It is an object of the present invention to provide a method of making a fluid impermeable wall in the ground which does not require excavating a series of vertical slots. Furthermore, it is another object to provide a method of making a fluid impermeable wall in one continuous slab without having any joints or flexible membranes therein. It is also an object of the present invention to provide a method of excavating a trench wherein the excavation occurs through a light viscous thixotropic liquid.

These and other objects will become apparent by referring to the present invention which provides in a method of constructing an impermeable wall in the ground having no joints therein, the improvement comprising the steps of, excavating at least one portion of trench in the ground at a width and depth required for the wall, replacing excavated material from the trench with bentonite-water slurry, after completing excavation of the one portion of trench, replacing a predetermined amount of the bentonite-water slurry with cement, mixing the cement with the remaining bentonite-water slurry in the one portion of trench to produce an evenly mixed cement-bentonite-water slurry, after the cement-bentonite-water slurry has gelled but not hardened, repeating the above steps on further portions of trench adjacent to previously excavated portions of trench until the completed trench is the required length and full of evenly mixed cement-bentonite-water slurry, and allowing the cement-bentonite-water slurry to harden and form a single impermeable wall.

The present invention permits the use of a horizontal excavation of the trench by means of a back hoe. This means that except in cases of very deep trenches, chisels or toothed grabs generally used in the excavation of slots are not required. Furthermore, the trench is dug in portions, but the edge between portions does not have to be straight and vertical, the edge can be exactly the shape that an operator using a back hoe digger leaves at the end of a shift. In fact it is preferable to have the edge of a portion rough and sloped or curved as this improves the strength of the total wall and ensures that a bending or pressure stress occurring on the finished wall is not going to occur at a line where an edge occurred.

Horizontal digging of a trench is generally carried out using a back hoe. A back hoe has at least two linked articulated arms with a shovel at the end of the outside arm. The digging motion is more easily performed by horizontal sweeps in a single plane to excavate a trench. Such excavations could also be carried out with special types of mechanical shovels. Back hoes are available to excavate down to depths of approximately thirty-five feet. Special adaptors are available for using some back hoes to excavate to depths of fifty feet. These depths are usually sufficient when digging a slot or trench for an impermeable wall to be poured in the earth. However, if deeper trenches are required, then chisels or toothed grabs are generally used. When commencing the excavation it is necessary to have a tank of a mixed thixotropic liquid, preferably a bentonite-water slurry, available so it may be pumped into the excavation at the same time as the earth is removed from the trench. A thixotropic liquid is one which when agitated has a low viscosity, but when left standing sets or gels to a higher viscosity. This property allows the liquid, preferably a bentonite-water slurry, to hold back soil particles on the edge of a trench wall from falling to the bottom of the trench. The properties of a bentonite-water slurry which affect trench stability are its density, viscosity in the agitated state and in the stable state. These properties may be changed by varying the concentration of bentonite in the slurry and by variations in the bentonite mix to suit the particular soil conditions. The slurry is mud color thus a back hoe operator excavates primarily by experience and feel. He cannot see the bottom of the trench.

If the impervious wall is a long wall, then it may take several days to dig the trench, and therefore the trench is dug in a series of shifts. At the end of each operators shift the end of the trench need not be vertical but may be sloped or stepped but is preferably uneven.

The back hoe may be removed at the end of each shift and the cement added and mixed with the bentonite-water slurry. Alternatively the required total length may be dug in a series of shifts with only bentonite-water slurry in the trench, and then after completion of the digging, cement is added and mixed with the bentonite-water slurry in the complete trench.

One method of mixing the cement is to have a separate mixing tank beside the trench and pump a small quantity on bentonite-water slurry from the top of the trench into the tank, mix cement with the slurry and then feed the cement-bentonite-water slurry back into the trench through a pipe that feeds the mixture to the bottom of the trench. The final mixing may be carried out by using an air hose connected to a straight pipe which is inserted into all parts of the trench to allow air to bubble through the mix.

Another method of mixing cement and bentonite-water slurry, is to first prepare a cement-water slurry mix in a tank beside the trench and then feed the cement-water slurry to the bottom of the trench while withdrawing bentonite-water slurry from the top of the trench. The final mixing in the trench is then carried out by bubbling air through the trench.

The addition of cement to a bentonite-water slurry tends to destroy the thixotropic qualities of the slurry and results in a gel in the form of a thick permeable filter cake having a composition similar to soft cheese. This gel holds the cement particles in suspension, and the cement takes a predetermined time to harden. Additives may be added to the cement so that the hardening time can be increased or reduced as desired. The hardening of the cement-bentonite-water slurry preferably occurs after the complete trench has been dug, even though it may have been excavated in shifts over a number of days and cement mixed with the bentonite-water slurry after each shift.

When the next portion of trench is excavated, the back hoe cuts through the edge of the cement-bentonite-water slurry in the previous portion of trench because the slurry is only in a gelled state and easily cut with a back hoe. At the same time as this gelled material is removed, bentonite-water slurry is added to prevent the sides of the trench collapsing.

When the edge of the previous portion of trench has been over dug, the next portion of trench is excavated. After completing this next portion, cement is again mixed with the bentonite-water slurry and it is found that where the two portions of trench meet, a completely impervious bond occurs because the cement in the previous portion was not cured when the cement-bentonite-water slurry was left overnight or for a predetermined time.

In one example 200 to 400 lbs. of cement were added for each cubic yard of the bentonite-water slurry. Additives were included in the cement so the cement did not cure for ten days which was longer than the time to excavate the complete trench. The bond between the trench portions were completely impervious and did not leak.

The embodiments of the invention in which an exclusive property or privilege is claimed are defined as follows:

1. In a method of constructing an impermeable wall in the ground having no joints therein, the improvement comprising the steps of:

excavating at least one portion of trench in the ground at a width and depth required for the wall, replacing excavated material from the trench with bentonite-water slurry, after completing excavation of the one portion of trench, replacing a predetermined amount of the bentonite-water slurry with cement by pumping out the bentonite-water slurry from at least one portion of trench into a mixer where the cement is added and the slurry fed back into the one portion, mixing the cement with the remaining bentonite-water slurry in the one portion of trench to produde an evenly mixed cement-bentonite-water slurry, after the cement-bentonite-water slurry has gelled but not hardened, repeating the above steps on further portions of trench adjacent to previously excavated portions of trench until the completed trench is the required length and full of evenly mixed cement-bentonite-water slurry, and allowing the cement-bentonite-water slurry to harden and form a single impermeable wall.

2. In a method of constructing an impermeable wall in the ground having no joints therein, the improvement comprising the steps of:

excavating at least one portion of trench in the ground at a width and depth required for the wall, replacing excavated material from the trench with bentonite-water slurry, after completing excavation of the one portion of trench, replacing a predetermined amount of the bentonite-water slurry with cement, mixing the cement with the remaining bentonite-water slurry in the one portion of trench by means of feeding compressed air into the one portion to produce an evenly mixed cement-bentonite-water slurry, after the cement-bentonite-water slurry has gelled but not hardened, repeating the above steps on further portions of trench adjacent to previously excavated portions of trench until the completed trench is the required length and full of evenly mixed cement-bentonite-water slurry, and allowing the cement-bentonite-water slurry to harden and form a single impermeable wall.

3. In a method of constructing an impermeable wall in the ground having no joints therein, the improvement comprising the steps of:

excavating at least one portion of trench in the ground at a width and depth required for the wall, replacing excavated material from the trench while bentonite-water slurry, after completing excavation of the one portion of trench, replacing a predetermined amount of the bentonite-water slurry with cement so as to add approximately 200 to 400 lbs. of cement for each cubic yard of the bentonite-water slurry, mixing the cement with the remaining bentonite-water slurry in the one portion of trench to produce an evenly mixed cement-bentonite-water slurry, after the cement-bentonite-water slurry has gelled but not hardened, repeating the above steps on further portions of trench adjacent to previously excavated portions of trench until the completed trench is the required length and full of evenly mixed cement-bentonite-water slurry, and allowing the cement-bentonite-water slurry to harden and form a single impermeable wall.

4. In a method of construcing an impermeable wall in the ground having no joints therein, the improvement comprising the steps of:

excavating at least one portion of trench in the ground at a width and depth required for the wall, replacing excavated material from the trench with bentonite-water slurry, after completing excavation of the one portion of trench, replacing a predetermined amount of the bentonite-water slurry with cement and additives to extend the time to harden the cement-bentonite-water slurry in excess of the time to excavate the complete length of the trench, mixing the cement with the remaining bentonite-water slurry in the one portion of trench to produce an evenly mixed cement-bentonite-water slurry, after the cement-bentonite-water slurry has gelled but not hardened, repeating the above steps on further portions of trench adjacent to previously excavated portions of trench until the completed trench is the required length and full of evenly mixed cement-bentonite-water slurry, and allowing the cement-bentonite-water slurry to harden and form a single impermeable wall.

5. In a method of constructing an impermeable wall in the ground having no joints therein, the improvement comprising the steps of;

excavating at least one portion of trench in the ground at a width and depth required for the wall, replacing excavated material from the trench with bentonite-water slurry, after completing excavation of the one portion of trench, replacing a predetermined amount of the bentonite-water slurry with cement, mixing the cement with the remaining bentonite-water slurry in the one portion of trench to produce an evenly mixed cement-bentonite-water slurry, after the cement-bentonite-water slurry has gelled but not hardened, repeating the above steps on further portions of trench adjacent to previously excavated portions of trench including excavating an adjacent end of the gelled cement-bentonite-water mix in the one portion of trench until the completed trench is the required length and full of evenly mixed cement-bentonite-water slurry, and allowing the cement-bentonite-water slurry to harden and form a single impermeable wall.

* * * * *